US012606890B2

(12) United States Patent
Aoyama et al.

(10) Patent No.: US 12,606,890 B2
(45) Date of Patent: Apr. 21, 2026

(54) TUNGSTEN WIRE, TUNGSTEN WIRE PROCESSING METHOD USING THE SAME, AND ELECTROLYZED WIRE

(71) Applicant: Niterra Materials Co., Ltd., Yokohama (JP)

(72) Inventors: Hitoshi Aoyama, Yokohama (JP); Hideaki Baba, Yokohama (JP); Kenji Tomokiyo, Yokohama (JP)

(73) Assignee: Niterra Materials Co., Ltd., Yokohama (JP)

( * ) Notice: Subject to any disclaimer, the term of this patent is extended or adjusted under 35 U.S.C. 154(b) by 349 days.

(21) Appl. No.: 18/360,948

(22) Filed: Jul. 28, 2023

(65) Prior Publication Data

US 2023/0366069 A1 Nov. 16, 2023

Related U.S. Application Data

(63) Continuation of application No. PCT/JP2022/005306, filed on Feb. 10, 2022.

(30) Foreign Application Priority Data

Feb. 17, 2021 (JP) ..... 2021-023070

(51) Int. Cl.
*C22C 27/04* (2006.01)
*B21B 1/18* (2006.01)
(Continued)

(52) U.S. Cl.
CPC ..... *C22C 27/04* (2013.01); *B21B 1/18* (2013.01); *B22F 3/14* (2013.01); *B22F 3/24* (2013.01); *B22F 5/12* (2013.01); *C22C 1/045* (2013.01); *C22F 1/02* (2013.01); *C22F 1/18* (2013.01); *C25F 3/26* (2013.01);
(Continued)

(58) Field of Classification Search
CPC . C22C 27/04; C22C 1/045; B22F 5/12; B22F 3/14; C22F 1/18; C22F 1/02
See application file for complete search history.

(56) References Cited

U.S. PATENT DOCUMENTS

2003/0129426 A1 7/2003 Kunishi et al.
2018/0326519 A1 11/2018 Kanazawa et al.
(Continued)

FOREIGN PATENT DOCUMENTS

CN 102586663 A 7/2012
CN 105750342 A 7/2016
(Continued)

OTHER PUBLICATIONS

International Search Report issued May 10, 2022 in PCT/JP2022/005306 filed on Feb. 10, 2022 citing documents 2-3, 16-23 therein, 3 pages.
(Continued)

*Primary Examiner* — Jessee R Roe
(74) *Attorney, Agent, or Firm* — Oblon, McClelland, Maier & Neustadt, L.L.P.

(57) ABSTRACT

A tungsten wire according to an embodiment is a tungsten wire made of a W alloy containing rhenium, and includes a mixture on at least a part of a surface thereof, the mixture contains W, C, and O as constituent elements, and taking a radial cross-sectional thickness of the mixture as A mm and a diameter of the tungsten wire as B mm, an average value of a ratio A/B of A to B is 0.3% to 0.8%.

9 Claims, 6 Drawing Sheets

(51) Int. Cl.

| | |
|---|---|
| ***B22F 3/14*** | (2006.01) |
| ***B22F 3/24*** | (2006.01) |
| ***B22F 5/12*** | (2006.01) |
| ***C22C 1/04*** | (2023.01) |
| ***C22F 1/02*** | (2006.01) |
| ***C22F 1/18*** | (2006.01) |
| ***C25F 3/26*** | (2006.01) |

(52) U.S. Cl.
CPC ... *B22F 2003/247* (2013.01); *B22F 2003/248* (2013.01); *B22F 2201/013* (2013.01); *B22F 2301/20* (2013.01); *B22F 2998/10* (2013.01); *B22F 2999/00* (2013.01)

(56) References Cited

U.S. PATENT DOCUMENTS

| | | | |
|---|---|---|---|
| 2019/0232404 | A1 | 8/2019 | Kanazawa et al. |
| 2022/0098708 | A1 | 3/2022 | Kanazawa et al. |

FOREIGN PATENT DOCUMENTS

| | | | |
|---|---|---|---|
| CN | 108034939 | A | 5/2018 |
| EP | 1 435 398 | A1 | 7/2004 |
| JP | 58-29522 | A | 2/1983 |
| JP | 58-104150 | A | 6/1983 |
| JP | 61-30215 | A | 2/1986 |
| JP | 4-249086 | A | 9/1992 |
| JP | 2532004 | B2 | 9/1996 |
| JP | 2637255 | B2 | 8/1997 |
| JP | 11-86800 | A | 3/1999 |
| JP | 2000-100377 | A | 4/2000 |
| JP | 2000-340335 | A | 12/2000 |
| JP | 2002-356732 | A | 12/2002 |
| JP | 2006-28643 | A | 2/2006 |
| JP | 3803675 | B2 | 8/2006 |
| JP | 4256126 | B2 | 4/2009 |
| JP | 2018-187741 | A | 11/2018 |
| JP | 2019-131841 | A | 8/2019 |
| JP | 2020-105548 | A | 7/2020 |
| WO | WO 2010/100808 | A1 | 9/2010 |

OTHER PUBLICATIONS

Extended European Search Report issued May 20, 2025 in European Patent Application No. 22756086.9, citing document 15 therein, 9 pages.

Japanese Decision to Grant issued Sep. 2, 2025 in Japanese Patent Application No. 2024-159006 (with unedited computer-generated English Translation), 6 pages.

Combined Chinese Office Action and Search Report issued Aug. 5, 2025 in Chinese Patent Application No. 202280014992.6, 7 pages.

Tungsten wire

Schematic radial cross-sectional view of tungsten wire (X-X cross-section of FIG. 1)

Schematic view of mixture at indiscriminate point A in radial cross section

O amount change of mixture in radial cross section (EPMA line analysis)

FIG. 4-1: Comparative Example 3

FIG. 4-2: Example 2

O amount change of mixture in radial cross section (EPMA line analysis)

Deformation model of wire and stresses at center and surface in wire drawing

Difference in shape of mixture layer in radial cross section (schematic diagram)

FIG. 6-1: Comparative Example 3

Difference in shape of mixture layer in radial cross section (schematic diagram)

FIG. 6-2: Example 2

Radial cross-sectional shape (overall view) of wire body before/after electropolishing FIG. 7-1: Before electropolishing Radial cross-sectional shape (overall view) of wire body before/after electropolishing FIG. 7-2: After electropolishing

TUNGSTEN WIRE, TUNGSTEN WIRE PROCESSING METHOD USING THE SAME, AND ELECTROLYZED WIRE

CROSS-REFERENCE TO RELATED APPLICATIONS

This application is a Continuation Application of PCT Application No. PCT/JP2022/005306, filed Feb. 10, 2022 and based upon and claiming the benefit of priority from prior Japanese Patent Application No. 2021-023070, filed Feb. 17, 2021, the entire contents of all of which are incorporated herein by reference.

FIELD

Embodiments described hereafter relate to a tungsten wire, a tungsten wire processing method using the same, and an electrolyzed wire.

BACKGROUND

Conventionally, various tungsten (W) wires have been used for cathode heaters for electron guns used in televisions, filament materials for lighting for automobile lamps or home electrical appliances, high-temperature structural materials, contact materials, and components for discharge electrodes. Among them, a tungsten alloy (ReW) wire containing a predetermined amount of rhenium (Re) is excellent in high-temperature strength and ductility after recrystallization, and is widely used for heaters of electron tube and filament materials for vibration-resistant bulbs. It is also excellent in electrical resistance properties and wear resistance, and is used for components for high-temperature thermocouples, particularly, needles (probe pins) of probe cards for inspecting electrical properties of semiconductor integrated circuit (LSI) wafers or the like. In this inspection, a probe pin in which a tip is chemically or mechanically processed into a shape advantageous for contact is directly brought into contact with a terminal of an object to be inspected.

With development of technologies for improving the degree of integration and miniaturizing semiconductors, there is a continuing demand for narrower pitches and smaller diameters of pins in probe cards, and at current, even ReW pins having a wire diameter of 0.02 mm to 0.04 mm are being used. As the wire diameter of the probe pin is reduced, the number of pins arranged per unit area can be increased, which is advantageous for inspection of highly integrated LSI.

In the case of such a small-diameter W wire (thin wire), first, a sintered product is subjected to a swaging or wire drawing process and the like (primary processing) to obtain wires having a wire diameter in a certain range (0.3 mm to 1.5 mm). Thereafter, necessary steps such as wire drawing and heat treatment are added with respect to an appropriate amount of wires to obtain a predetermined tungsten wire (wire diameter). In this wire thinning step, breakage during wire drawing and linear fine concaves and convexity appearing on the material surface in the wire drawing direction (die marks: stated in JIS H0201 718)tend to occur. Breakage of a thin wire during wire drawing significantly lowers the yield, particularly in a multi-stage wire drawing machine that performs processing with a plurality of dies. Furthermore, the number of steps increases due to restoration and reactivation after breaking of wire. If the die mark cannot be removed even by subsequent surface polishing or probe pin processing, the die mark becomes a defect, deteriorating the yield and the processing cost.

As a conventional countermeasure against breaking of wire, the number of recrystallizations is controlled through heat treatment in an intermediate step to improve workability. For example, a ReW wire has been provided in which, when a cross-section reduction rate (area reduction rate) from a sintered product of a molded article exceeds 75% and reaches 90% or less, a final recrystallization treatment is performed to adjust the number of recrystallized grains in a center portion and a surface portion of the molded article to 500 grains/mm$^2$ to 800 grains/mm$^2$ (see Japanese Patent No. 2637255).

Furthermore, there has been report of one with workability improved by controlling the Re segregation phase (σ phase) in the W matrix. For example, with maldistribution of the σ phase, breaking of wire is likely to occur from the σ phase as a starting point during wire drawing, and therefore, a ReW wire is provided in which the maximum grain size of the σ phase is set to 10 μm or less (see Japanese Patent No. 4256126).

Furthermore, in secondary processing such as coil processing, if a lubricant containing graphite (C) remains in a concave portion of a material surface, the C component may contaminate W at a high temperature during processing, causing embrittlement. For this reason, the surface roughness is controlled to prevent embrittlement. For example, a ReW wire is provided in which a wire is drawn to a wire diameter of 0.175 mm and then subjected to electrolysis to thereby adjust the average interval and the maximum height of concaves and convexities on the surface of the material to predetermined ranges (see Japanese Patent No. 3803675).

The die mark is generally removed by a chemical polishing (electrolytic) process after wire drawing performed to a predetermined size. For example, there is a method of producing a W electrode in which a center line average roughness and a ten-point average roughness are defined and electrolytic treatment is performed until the defined values are reached (see Jpn. Pat. Appln. KOKAI Publication No. 2000-100377).

BRIEF DESCRIPTION OF THE DRAWINGS

FIG. 4-1 is a graph showing a change in oxygen amount of a mixture (EPMA line analysis) in a radial cross section in Comparative Example 3.

FIG. 4-2 is a graph showing a change in oxygen amount of a mixture (EPMA line analysis) in a radial cross section in Example 2.

FIG. 6-1 is a schematic view of Comparative Example 3 for illustrating a difference in shape of a mixture layer between Comparative Example 3 and Example 2 in a radial cross section.

FIG. 6-2 is a schematic view of Example 2 for illustrating a difference in shape of a mixture layer between Comparative Example 3 and Example 2 in a radial cross section.

FIG. 7-1 is a cross-sectional view illustrating a radial cross-sectional shape (overall view) of a wire body before electropolishing.

FIG. 7-2 is a cross-sectional view illustrating a radial cross-sectional shape (overall view) of the wire body after electropolishing.

DETAILED DESCRIPTION

Figure 1:
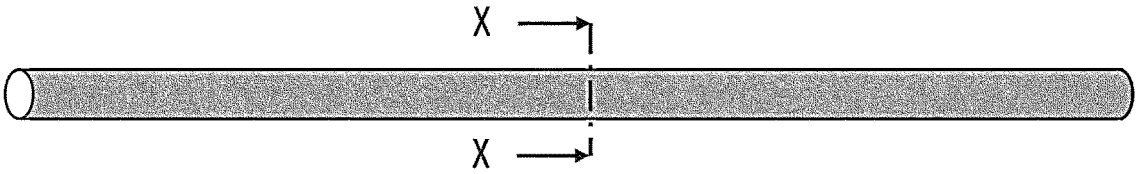
FIG. 1 shows an example of a tungsten wire for wire drawing according to an embodiment.

The method described in Japanese Patent No. 2637255 of controlling the number of crystals through heat treatment in an intermediate step requires a predetermined area reduction rate from a sintered product until recrystallization treatment is performed. In addition, it is an effect relevant to processing only down to the above-mentioned material size in which the final diameter is 1.0 mm. When considering application to a thin wire, the cross-sectional area of the sintered product needs to be made very small, and productivity is greatly diminished. In addition, with the recrystallization treatment size being small, there is a high possibility that the strength at the final size is lowered. For example, a probe pin is required to have such strength as not to be deformed through contact with a terminal of an object to be inspected, and therefore use would be difficult.

The method described in Japanese Patent No. 4256126 is very effective against breaking that starts from the σ phase. However, occurrence of segregation of the σ phase is controlled in the steps up to the production of the sintered product, and the subsequent steps are the same as in the conventional method. Therefore, breaking of wire due to other factors such as a die mark is not suppressed.

Japanese Patent No. 3803675 discloses a method of preventing embrittlement caused by reaction between W and C by providing a thin wire having a good surface property to easily evaporate C remaining on the surface by heating at a high temperature during secondary processing such as coiling. In the wire thinning processing of Japanese Patent No. 3803675, use of a C-based lubricant excellent in heat resistance is the generally case. The measure of evaporating C deteriorates lubricity and causes a risk such as seizure between the wire and the die.

Jpn. Pat. Appln. KOKAI Publication No. 2000-100377 discloses a method of removing and managing the generated die marks, and does not discuss suppression of die marks.

A problem to be solved by the present invention is to provide a W wire for wire drawing in which breakage during wire drawing and surface concavity and convexity are improved.

According to one embodiment, a tungsten (W) wire is provided. The tungsten wire according to the embodiment is a W wire made of a W alloy containing rhenium (Re), and includes a mixture on at least a part of a surface thereof, the mixture contains W, C, and O as constituent elements, and taking a radial cross-sectional thickness of the mixture as A mm and a diameter of the tungsten wire as B mm, an average value of a ratio A/B of A to B is 0.3% to 0.8%.

In the following, a tungsten wire for wire drawing according to an embodiment will be described with reference to the drawings. Hereinafter, the tungsten wire for wire drawing may be referred to as a W wire for wire drawing. It should be noted that the figures are schematic, and for example, a ratio of dimensions of each portion and the like are not limited to the figures.

FIG. 1 shows an example of a W wire sample taken from a W wire for wire drawing. The sample length is preferably, for example, a length with which cross-sectional observation through resin-embedding can be performed for a plurality of samples (100 mm to 150 mm). Although the sampling position may be optionally set, it is preferable to take samplings from portions other than forward and rear ends to perform subsequent steps with a high yield. Since the forward and rear ends include portions where conditions are unstable due to the initiation and halting of the wire drawing device, those portions are not included in the samplings. The length of the unstable portion varies depending on the layout or size of the device. The diameter of the collected sample in the XY direction is measured using a micrometer. The measurement is performed at three locations, and an average value of the obtained six data is defined as a diameter B (mm) of each sample.

Figure 2:
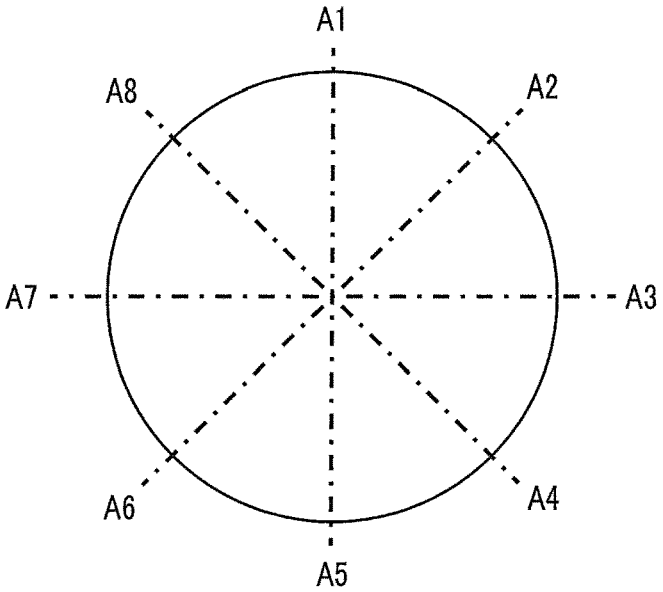
FIG. 2 is a schematic radial cross-sectional view of the tungsten wire (cross-section taken along X-X in FIG. 1).
Figure 3:
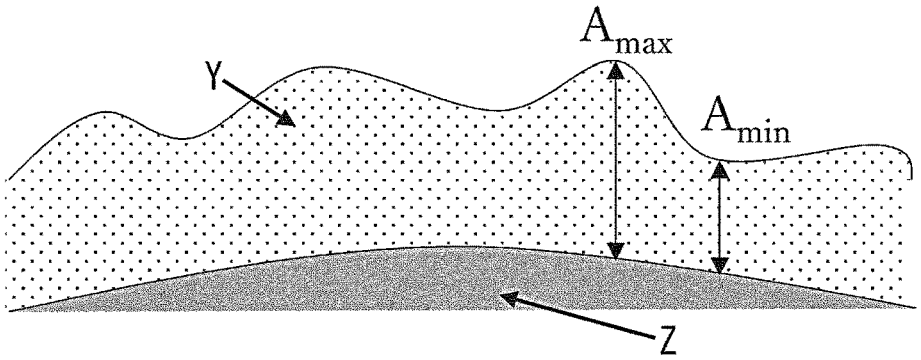
FIG. 3 is a schematic view of a mixture at an indiscriminate point A in the radial cross section.

FIG. 2 is a cross-sectional view taken along an X-X cross-section in FIG. 1 (cross-section perpendicular to the wire drawing direction: radial cross-section). As shown in the figure, straight lines passing through the center of the cross-section and equally dividing it into eight are drawn, and intersections of the lines with the outer periphery are defined as A1 to A8. The mixture is observed at the discriminately determined eight equally spaced locations on the outer periphery. FIG. 3 shows a schematic view of the mixture at one indiscriminate location. For example, by embedding a sample in resin and polishing, an observation image becomes clear, but through this process, the mixture may be peeled off. Such a portion is excluded from the measurement site. Using an SEM image observed at a magnification of 10,000 times, the thicknesses of the thickest portion ($A_{max}$) and the thinnest portion ($A_{min}$) of the mixture are determined in a region of 30 μm×30 μm, and the average value thereof is defined as a thickness of the mixture. In the same manner, the thicknesses of eight locations (A1 to A8) in the same cross section are determined. Among them, the thickness at one indiscriminate point is defined as A (mm). The diameter B of the observed sample is used to determine a ratio A/B (%) of A to B. In one same cross section, the number of data of A/B is 8. Based on the number (n) of observed samples, the number of data of A/B would be "8×n".

The average value of A/B of the tungsten wire according to the embodiment is 0.3% to 0.8% (0.003 to 0.008). More preferably, the value is 0.3% to 0.6% (0.003 to 0.006). If the average value of A/B is smaller than 0.3%, breakage would occur in wire drawing, and if the ratio of A/B is greater than 0.8%, the rate of occurrence of die marks increases. If the average value of A/B is within the range of 0.3% to 0.8%, breakage in wire drawing and occurrence of die marks can be suppressed.

Figures 1, 4:
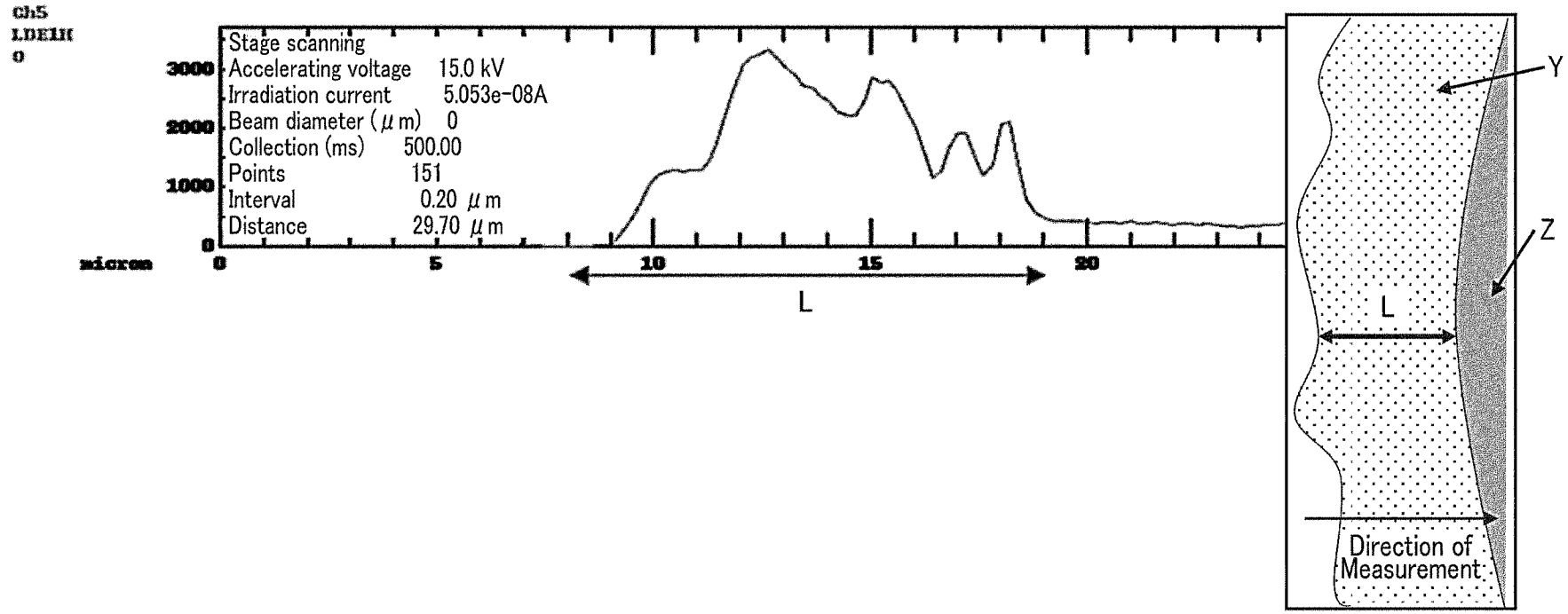
Figures 2, 4:
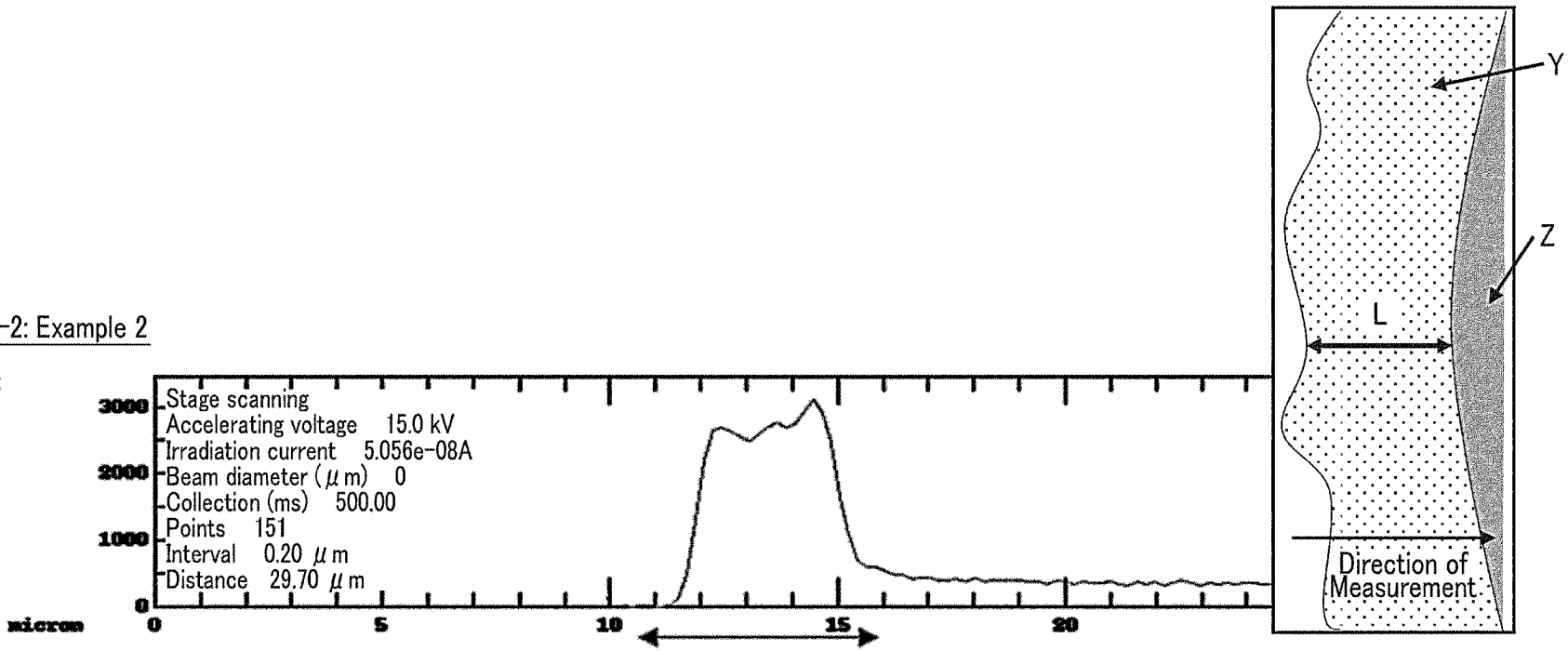

FIG. 4 (FIG. 4-1 and FIG. 4-2) shows, as an example, the results of analysis of the amount of O (oxygen) in the mixture in the radial cross section at diameter 0.80 mm. FIG. 4-1 shows a measurement result of one site of Comparative Example 3, and FIG. 4-2 shows a measurement result of one site of Example 2. The analysis was performed using EPMA (electron probe microanalyzer: JXA-8100 manufactured by JEOL Ltd.) under the conditions of accelerating voltage: 15 kV, sample current: $5.0\times10^{-8}$A, beam diameter: Spot (~Φ1 μm), analyzing time: 500 ms/point, scanning mode: stage scanning, and analyzing distance: 29.7 μm (151 points). The vertical axis represents the number of counts, and the horizontal axis represents the observation direction distance. Hereinafter, Comparative Example 3 may be referred to as a conventional W wire.

The A/B of the observation site is 1.4% (0.014) in the conventional W wire and 0.7% (0.007) in Example 2. O in the mixture of the conventional W wire varies in the cross-sectional direction (the length L of the mixture), whereas it is stable in Example 2. O in the mixture is present as a compound (oxide) with W. Compositions of an oxide of W include $WO_3$, $W_{20}O_{58}$, $W_{18}O_{49}$, $WO_2$, and $W_3O$, whose physical properties (strength and adhesion) differ. In the conventional W wire, O in the cross-section of the mixture exhibits variance, which indicates that oxides having different compositions exist within the cross section. This results in non-uniformity in deformation at the time of wire drawing, causing cracking or falling of the oxide film. There is a high possibility that the portion where falling occurred becomes a die mark.

Figure 5:
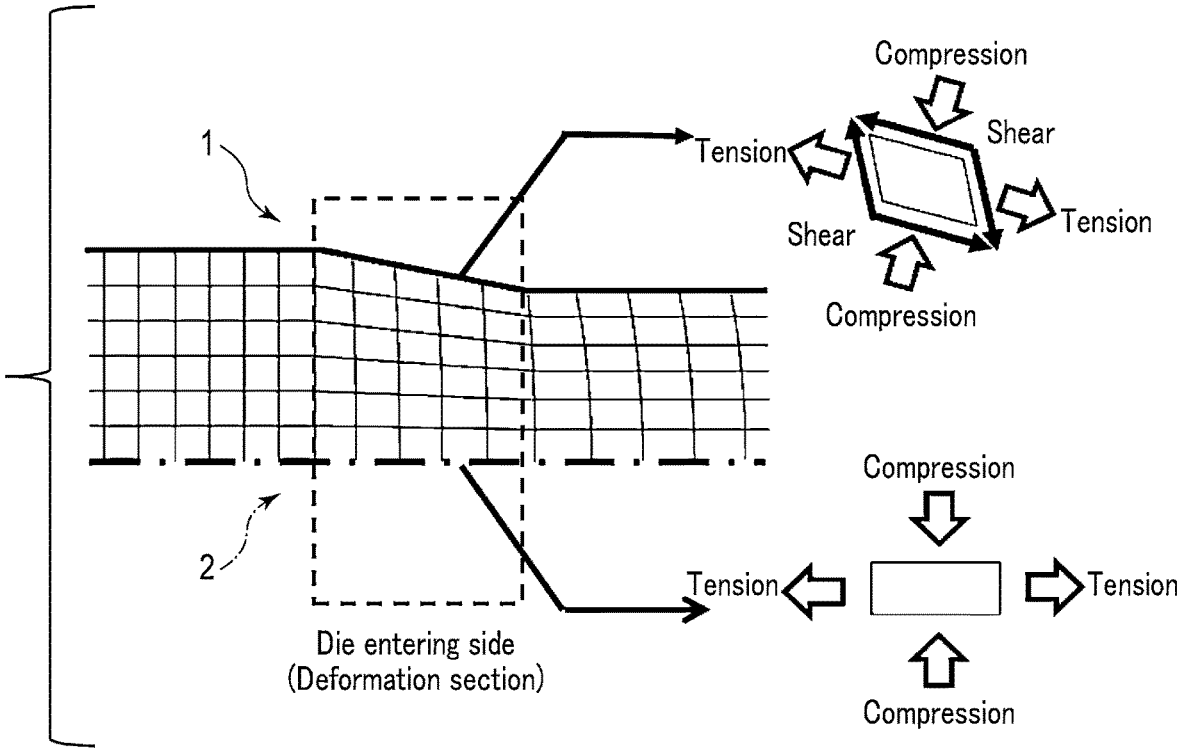
FIG. 5 is a schematic cross-sectional view showing a deformation model of a drawn wire and stresses at a center and a surface.

FIG. 5 shows a deformation model of a wire and stresses at a center and a surface upon wire drawing. Through contact with the die during wire drawing, a shearing force is generated in the wire surface layer. An outer peripheral portion 1 is plastically deformed by the shearing force as well. For this reason, the material does not elongate uniformly throughout the radial cross section, but is more advanced towards a center portion 2. If the mixture on the surface is thick, the amount of shear deformation of the mixture layer is greater than when the mixture is thin. Therefore, the shearing force acting between W and the mixture becomes larger as the layer is thicker. This causes a partial falling of the mixture. The existence of the oxides having different compositions in the mixture described above further makes falling more likely to occur.

If the average value of A/B is smaller than 0.3% (0.003), W and C directly react with each other, increasing the risk of embrittlement. In addition, there is a possibility that sufficient lubricity cannot be secured.

Next, for A/B of the same cross section (the number of data being 8), an average value (Ave), a standard deviation (Sd), and a coefficient of variation (CV) calculated by Sd/Ave are determined. The CV indicates a ratio of a magnitude of variation in data with respect to the average, and the variation can be compared regardless of whether the layer is thin or thick.

In the tungsten wire of the embodiment, the CV within the same cross section is preferably 0.30 or less. It is more preferably 0.20 or less. If the CV is greater than 0.30, there is a high possibility that breakage in wire drawing or die marks occur. If the variation in the thickness of the mixture is large, there is a possibility that A/B is partially a large value or a small value. In such a portion, there is a risk of causing defects such as falling or cracking of the mixture and C embrittlement of the W wire as described above.

Figures 1, 6:
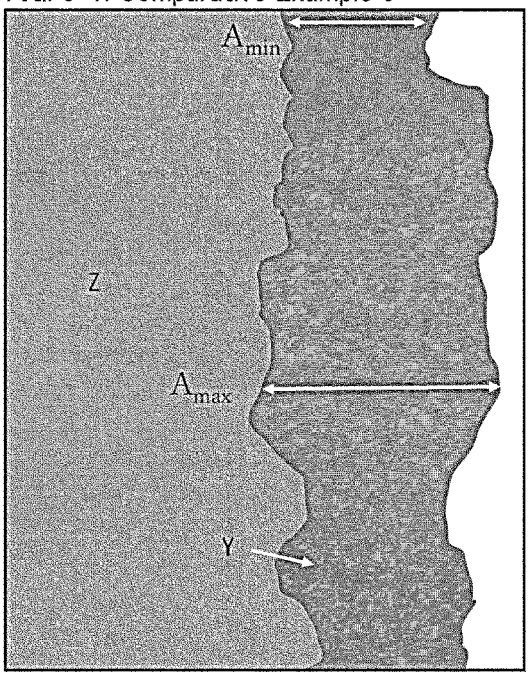
Figures 2, 6:
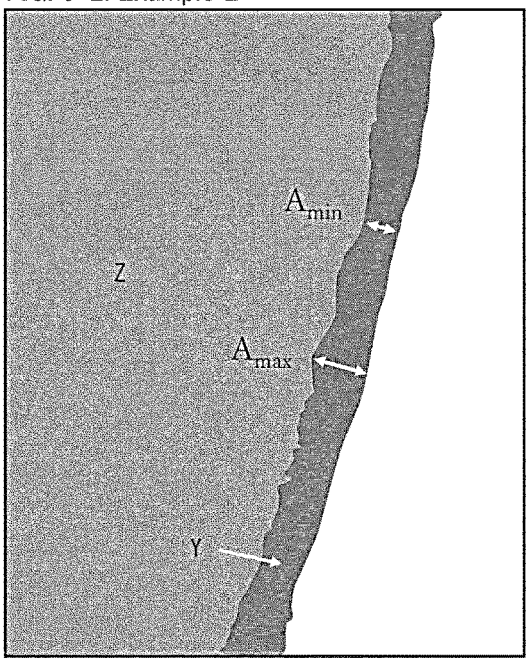

FIG. 6 (FIG. 6-1 and FIG. 6-2) schematically shows, as an example, the difference in the shape of the mixture in the radial cross section at diameter 0.8 mm. When an actual sample was observed with an SEM at a magnification of 5000 times with respect to an outer peripheral length of 60 μm in a cross-section, there was a large difference in that the difference in thickness ($A_{max}$–$A_{min}$) was 6 μm for the conventional wire and was 1 μm for Example 2. Furthermore, the CV of the cross-section was 0.5 for the conventional wire and 0.1 for Example 2. If the CV is large, there is a high possibility that not only the difference (variation) in thickness depending on the position on the outer periphery but also the difference (variation) in thickness at the same site is large. In the mixture layer having such a form, the working force is not uniform at the time of wire drawing, and cracking or falling is likely to occur.

Energy dispersive X-ray spectrometry (EDS, accelerating voltage: 15 kV, magnification: 10,000 times, measurement range: 30 μm×30 μm) is performed using a Phenom ProX desktop scanning electron microscope on the cross-section from which the A/B data is obtained. The center portions in the thickness direction of the mixture are measured at $A_{max}$ and $A_{min}$ of the mixture within the measurement range, and an average value is obtained. The measurement is performed at indiscriminate five points among the eight points (A1 to A8) in the cross-section, and the ratio (O wt %/W wt %) at each point is determined from the obtained data values of W (wt %) and O (wt %). W (wt %) is a percent by mass of tungsten, and O (wt %) is a percent by mass of oxygen.

In the W wire of the embodiment, the average value of the ratio (O wt %/W wt %) of O (wt %) to W (wt %) is preferably 0.10 or less at the center portion in the thickness direction of the mixture. If the value exceeds 0.10, there is a possibility that among the W oxides, formation of $WO_3$ proceeds. Since $WO_3$ has a very brittle physical property, the mixture easily falls off. The lower limit is not particularly limited, but is preferably 0.05 or more. If the value is less than 0.05, the formation of W oxides is insufficient, and the reaction between C in the C layer and W easily occurs.

The amount of Re contained in the W wire of the embodiment is preferably 1 wt % to 30 wt %, and more preferably 2 wt % to 28 wt %. If the Re content is less than 1 wt %, the strength is decreased, and if the wire is used for a probe pin, for example, the amount of deformation increases with the frequency of use, and contact failure occurs, whereby the precision of inspecting a semiconductor is diminished. If the Re content is more than about 28 wt %, the content exceeds the solid solubility limit with W, and thus maldistribution of the σ phase easily occurs. This phase becomes a starting point of breaking during wire drawing, and there is a possibility that the process yield is greatly lowered. By setting the Re amount to be 1 wt % to 30 wt % or 2 wt % to 28 wt %, for example, an electrolyzed wire for a probe pin using the material of the present embodiment can be produced with a high yield while securing mechanical properties (strength and wear resistance).

The W wire of the embodiment may contain 30 wt ppm to 90 wt ppm of K as a doping agent. When K is contained, tensile strength and creep strength at high temperature are enhanced because of a doping effect. If the K content is smaller than 30 wt ppm, the doping effect would be insufficient. If the content exceeds 90 wt ppm, there is a possibility that the workability is lowered and the yield is significantly lowered. By containing 30 wt ppm to 90 wt ppm of K as a doping agent, for example, a thin wire for thermocouples or heaters of electronic tube using the material of the present embodiment can be produced with a high yield while securing high-temperature properties (prevention of breaking and deformation of wire during high-temperature use).

According to the embodiment, it is possible to realize a tungsten wire for wire drawing in which occurrence of breakage or surface concavity and convexity are suppressed at the time of wire drawing and which greatly contributes to improvement in yield, and the tungsten wire can be applied to use in an electrolyzed wire for a probe pin. The wire can also be applied to use in high temperature thermocouples.

Next, a method of producing the W wire for wire drawing according to the present embodiment will be described. Though the production method is not particularly limited, examples thereof include the following methods.

W powder and Re powder are mixed so that the Re content is 1 wt % or more, for example, 3 wt % or more and 30 wt % or less. The mixing method is not particularly limited, but a method of mixing powders in a slurry form using water or an alcohol solution is particularly preferable because a powder having good dispersibility can be obtained. The Re powder to be mixed preferably has a maximum particle diameter of less than 100 μm. Furthermore, the average particle diameter is preferably less than 20 μm. The W powder is pure W powder disregarding inevitable impurities, or doped W powder containing K in an amount in consideration of the yield up until the wire material. The W powder preferably has an average particle diameter of less than 30 μm. If the maximum particle size or the average particle size of the Re powder is equal to or greater than the above, a coarse σ phase is likely to be formed. If the average particle diameter of the W powder is equal to or greater than the above, moldability is deteriorated at the time of press-molding in the subsequent step, and breakage, chipping, cracking or the like is likely to occur in the formed product.

For example, in the case of producing W-Re mixed powder having a Re content of more than 18 wt %, first, a ReW alloy having a Re content of 18 wt % or less is produced by a powder metallurgy method, a melting method or the like, and then finely pulverized by an ordinary method. There is also a method of mixing an amount of Re deficient with respect to a desired composition. Hereinafter, a tungsten wire containing Re may be referred to as a ReW wire.

Next, the mixed powder is put into a predetermined mold and press-molded. The pressing pressure at this time is preferably 100 Mpa or more. The molded product may be subjected to a preliminary sintering treatment at 1200° C. to 1400° C. in a hydrogen furnace so as to facilitate handling. The obtained molded product is sintered in a hydrogen atmosphere, an inert gas atmosphere such as that of argon, or a vacuum. The sintering temperature is preferably 2125° C. or higher. If the temperature is lower than 2125° C., densification by sintering does not sufficiently proceed. The upper limit of the sintering temperature is 3400° C. (below or equal to the melting point 3422° C. of W). The relative density after sintering (relative density with respect to true density (%)=[sintered product density/true density]×100%) is preferably 90% or more. By setting the relative density of the sintered product to 90% or more, it is possible to reduce occurrence of cracking, chipping, breaking, or the like in the subsequent swaging process (SW).

Molding and sintering may be performed simultaneously by hot pressing in a hydrogen atmosphere, an inert gas atmosphere such as that of argon, or in a vacuum. The pressing pressure is preferably 100 MPa or more, and the heating temperature is preferably 1700° C. to 2825° C. In this hot pressing method, a dense sintered product can be obtained even at a relatively low temperature.

The sintered product obtained in the sintering step is subjected to a first swaging process. The first swaging process is preferably performed at a heating temperature of 1300° C. to 1600° C. The reduction rate of the cross-sectional area (area reduction rate) attained by processing of a single heat treatment (one heating) is preferably 5% to 15%.

Instead of the first swaging process, a rolling process may be performed. The rolling process is preferably performed at a heating temperature of 1200° C. to 1600° C. The area reduction rate through one heating is preferably 40% to 75%. For a rolling unit, a 2-directional roll rolling unit, a 4-directional roll rolling unit, a die roll rolling unit or the like can be used. The rolling process makes it possible to greatly increase the production efficiency. The first swaging process and the rolling process may be combined.

The sintered product (ReW bar) that has completed the first swaging process, the rolling process, or a combination thereof is subjected to a second swaging process. The second swaging process is preferably performed at a heating temperature of 1200° C. to 1500° C. The area reduction rate through one heating is preferably approximately 5% to 20%.

Next, the ReW bar that has completed the second swaging step is subjected to a recrystallization treatment. The recrystallization treatment can be performed using, for example, a high-frequency heating apparatus in a hydrogen atmosphere, an inert gas atmosphere such as that of argon, or a vacuum at a treatment temperature in the range of 1800° C. to 2600° C.

The ReW bar that has completed the recrystallization treatment is subjected to a third swaging process. The third swaging process is preferably performed at a heating temperature of 1200° C. to 1500° C. The area reduction rate through one heating is preferably approximately 10% to 30%. The third swaging process is performed until the ReW bar has a diameter at which wire drawing can be performed (preferably a diameter of 2 mm to 4 mm).

The ReW bar that has completed the third swaging process is subjected to a first wire drawing process in which a treatment of applying a lubricant to the surface, in order to enable smooth wire drawing, a treatment of drying the lubricant and heating to a workable temperature, and a treatment of wire drawing using a drawing die are repeated until the diameter reaches 0.7 mm to 1.2 mm. As the lubricant, use of a C-based lubricant excellent in heat resistance is desirable. The working temperature is preferably 800° C. to 1100° C. The workable temperature varies depending on the diameter and is higher for larger diameters. If the temperature is lower than the workable temperature, cracks or breaking of wire frequently occur. If the temperature is higher than the workable temperature, seizure between the wire and the die occurs or deformation resistance of the wire decreases, whereby a diameter variation (thinning) after drawing occurs due to a drawing force. The area reduction rate is preferably 15% to 35%. If less than 15%, the difference in structure between the inside and the outside and the residual stress are generated in the processing, which causes cracks. If greater than 35%, the drawing force becomes excessive, and the diameter after wire drawing varies greatly, resulting in breakage. The wire drawing speed is determined by the balance of the capacity of the heating device, the distance from the device to the die, and the area reduction rate.

Depending on the processing conditions (heating temperature, atmosphere, etc.), the mixture formed in the surface layer, particularly the composition of the W oxide, varies. Through repeating the heating, the processing conditions are more likely to vary. Furthermore, with changes in diameter, the optimum working temperature changes. In particular, in a case of a large diameter, the heating temperature needs to be increased, and the conditions are likely to vary. Therefore, there is a high possibility that W oxides having different compositions are generated with the thickness being increased. Thus, the wire drawn to a diameter of 0.7 mm to 1.2 mm is subjected to a polishing process to once remove the mixture generated on the surface by the processing up to that time and the concavity and convexity of the wire surface.

Figures 1, 7:
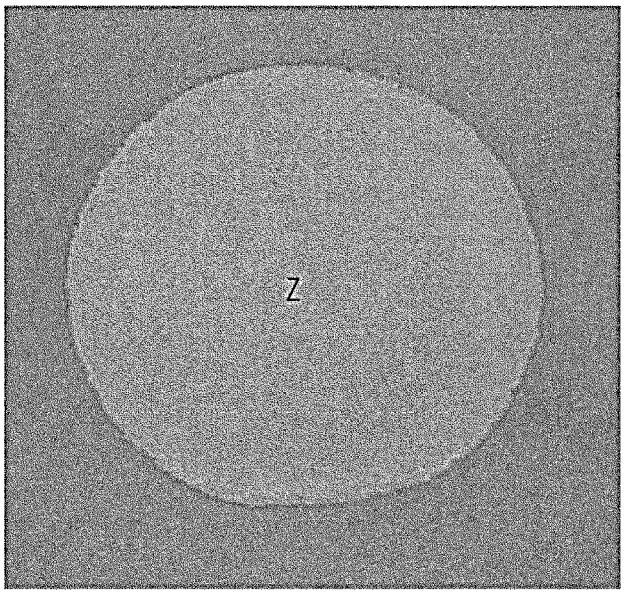
Figures 2, 7:
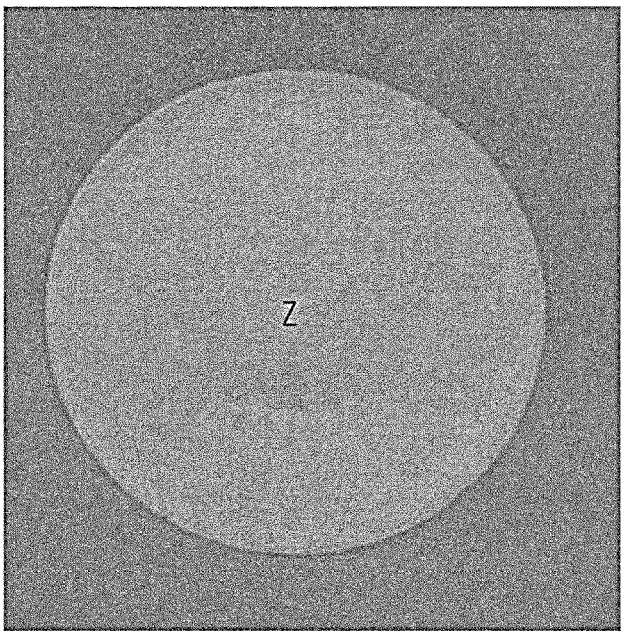

Examples of the polishing process include a method of electrochemically polishing (electropolishing) in an aqueous sodium hydroxide solution having a concentration of 7 wt % to 15 wt %. The area reduction rate through the polishing process is preferably 10 to 25%. If smaller than 10%, there is a possibility that the concavity and convexity of the material surface generated in the swaging step or the first wire drawing step as well as the mixture adhering thereto cannot be removed. If more than 25%, the material yield is deteriorated. In the case of electropolishing, the processing speed is preferably 0.5 m/min to 2.0 m/min. If slower than 0.5 m/min, the number of processing steps is greatly increased. If more than 2.0 m/min, the electrolysis amount per unit time increases and the electrolysis becomes rapid, whereby there is a possibility that the correction of the wire cross-sectional shape becomes insufficient. Alternatively, the device needs to be very large. FIG. 7 (FIG. 7-1 and FIG. 7-2) schematically shows the results of observing the radial cross-sectional shape of the ReW wire body before and after electropolishing. By the electropolishing, the concavity and convexity on the wire surface were eliminated.

The wire that has completed the polishing process is subjected to heat treatment in a furnace of air atmosphere to form a dense and uniform oxide layer on the surface. The heating temperature is preferably 700° C. to 1100° C. If the temperature is lower than 700° C., it is difficult to form an oxide. If the temperature is higher than 1100° C., variance in the oxide compositions arises. The processing speed is preferably 5 m/min to 20 m/min. If 5 m/min or lower, the number of processing steps is greatly increased. If 20 m/min or more, the amount of heat for raising the temperature needs to be made large, and the oxide composition layer tends to become non-uniform. Alternatively, the device needs to be made very large.

In order to form and adhere the C layer onto the oxide layer, a treatment of applying a lubricant onto the surface, a treatment of drying the lubricant and heating to a workable temperature, and a treatment of wire drawing using a drawing die are carried out. By having the C layer be adhered, the oxide layer is prevented from being altered or scraped off in a subsequent step. The area reduction rate is preferably 10% to 30%, and more preferably 15% to 25%. If less than 10%, the oxide layer and the C layer may not sufficiently adhere to each other. If more than 30%, the drawing force becomes excessive, and there is a possibility that the layer is scraped off on the die inlet side.

Thereafter, the second wire drawing is performed. The heating temperature is preferably 1000° C. or less. If the temperature exceeds 1000° C., there is a possibility that C in the adhered C layer reacts with O in the air to form $CO_2$ and is evacuated, whereby the C layer becomes sparse, and the composition of the oxide layer underneath changes. The area reduction rate through the second wire drawing is preferably 15% to 35% as in the first wire drawing. Through the second wire drawing, a W wire for wire drawing having a diameter of 0.3 mm to 1.0 mm is obtained.

Thereafter, an appropriate amount of W wires for drawing is subjected to additional steps such as wire drawing and heat treatment, as necessary, so as to obtain a W wire having a predetermined wire diameter and necessary properties (strength, hardness, etc.). This is electropolished to obtain an electrolyzed wire.

EXAMPLES

Sintered products having the compositions shown in Table 1 were produced by the powder mixing, molding and sintering methods described above. In Examples 1 to 6, the first swaging process, the rolling process, the second swaging process, the recrystallization treatment, the third swaging process, the first wire drawing process, the electropolishing, the heat treatment for forming the oxide layer, the wire drawing treatment for adhesion of the C layer, and the second wire drawing process were performed to obtain diameters shown in Table 1.

In Example 7, the area reduction rate was reduced to 8% in the electropolishing process after the first wire drawing process. In Comparative Example 1, the treatment temperature was lowered to 680° C. to 700° C. in the heat treatment for forming the oxide layer after the electropolishing, to make the mixture layer thinned. For Comparative Example 2, in the second wire drawing process, the heating temperature was increased to 1150° C. to make the mixture layer thickened. In Comparative Examples 3 to 5, a conventional processing was performed in which the second wire drawing process was performed sequentially after the first wire drawing process. Each was processed to the diameter shown in Table 1. Re and K were analyzed not by inductively coupled plasma-mass spectrometry (ICP-MS) suitable for evaluation of trace impurities, but by inductively coupled plasma-optical emission spectrometry (ICP-OES) suitable for evaluation of constituent elements. The lower detection limit of K is 5 wt ppm, and the case where the analytical value is lower than 5 wt ppm without addition is indicated by "–".

TABLE 1

| | Re (wt %) | K (wt ppm) | Diameter | |
|---|---|---|---|---|
| Example 1 | 3% | — | 0.3 mm | |
| Example 2 | 3% | — | 0.8 mm | |
| Example 3 | 3% | — | 1.0 mm | |
| Example 4 | 3% | 61 ppm | 0.8 mm | |
| Example 5 | 5% | — | 0.8 mm | |
| Example 6 | 26% | — | 0.8 mm | |
| Example 7 | 3% | — | 0.8 mm | Area Reduction Rate Reduced in Electropolishing |
| Comparative Example 1 | 3% | — | 0.8 mm | Treatment Temperature Lowered in Oxide Layer Forming |
| Comparative Example 2 | 3% | — | 0.3 mm | Heating Temperature Increased in Second Wire Drawing |
| Comparative Example 3 | 3% | — | 0.8 mm | Conventional Processing |
| Comparative Example 4 | 3% | 54 ppm | 0.8 mm | Conventional Processing |
| Comparative Example 5 | 26% | — | 0.8 mm | Conventional Processing |

Sampling was performed on the obtained wires, and the A/B, CV, and O wt %/W wt % were evaluated by the above-described methods. The mixture contained W, C, and O as constituent atoms. 1 kg of this wire was each used, and the wire was drawn to a diameter of 0.08 mm. The breakage defect rate during this wire drawing and the appearance defect rate after completion were examined.

For the breakage defect rate, when breaking of wire occurred during wire drawing and the weight of the wire after breaking was 0.05 kg or less, the weight was counted as a defect weight, and the total weight of defect weights was divided by the feeding weight (1 kg).

For the appearance defect rate, each 100 m portion at both ends of the wire after completion of wire drawing was cut to lengths of 50 mm, boiled in sodium hydroxide, and thus the mixture was removed. Next, observation was performed with a microscope at a magnification of 30 times, and when there were recognizable scratches, concavity and convexity on the surfaces, the 50 mm was counted as a die mark defect. The length considered defective was calculated and the defect rate was calculated by dividing the defect length by the evaluation length (200 m). The results are shown in Table 2.

TABLE 2

| | A/B | CV | O wt %/W wt % | Wire Drawing Breakage Defect Rate | Appearance Defect Rate |
|---|---|---|---|---|---|
| Example 1 | 0.3% | 0.14 | 0.08 | 0% | 0% |
| Example 2 | 0.5% | 0.10 | 0.07 | 0% | 1% |
| Example 3 | 0.7% | 0.08 | 0.08 | 3% | 2% |
| Example 4 | 0.4% | 0.20 | 0.07 | 0% | 1% |
| Example 5 | 0.6% | 0.10 | 0.10 | 1% | 2% |
| Example 6 | 0.8% | 0.15 | 0.09 | 4% | 5% |
| Example 7 | 0.8% | 0.31 | 0.11 | 5% | 17% |
| Comparative Example 1 | 0.2% | 0.23 | 0.04 | 31% | 6% |
| Comparative Example 2 | 1.0% | 0.15 | 0.12 | 10% | 20% |
| Comparative Example 3 | 1.0% | 0.48 | 0.16 | 13% | 37% |
| Comparative Example 4 | 0.9% | 0.33 | 0.12 | 8% | 24% |
| Comparative Example 5 | 1.2% | 0.57 | 0.11 | 18% | 42% |

As can be seen from the table, in the W wire for drawing according to the embodiment, the wire breakage defect rate and the appearance defect rate were reduced. In contrast, in the Comparative Examples, the wire breakage defect rate and the appearance defect rate were poor.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention. In addition, each of the above-mentioned embodiments can be carried out in combination with one another.

What is claimed is:

1. A tungsten wire comprising a tungsten alloy containing rhenium, the tungsten wire comprising a mixture on at least a part of a surface thereof, the mixture containing W, C, and O as constituent elements, and taking a radial cross-sectional thickness of the mixture as A mm and a diameter of the tungsten wire as B mm, an average value of a ratio A/B of A to B being 0.3% to 0.8%.

2. The tungsten wire according to claim 1, wherein the A/B has a coefficient of variation of 0.30 or less within a same cross section.

3. The tungsten wire according to claim 1, wherein in the mixture, an average value of a ratio of O (wt %) to W (wt %) (O wt %/W wt %) is 0.05 to 0.10 in a center portion in a thickness direction within a radial cross-section.

4. The tungsten wire according to claim 1, wherein a content of rhenium is 1 wt % to 30 wt %.

5. The tungsten wire according to claim 1, wherein a content of rhenium is 2 wt % to 28 wt %.

6. The tungsten wire according to claim 1, wherein a content of potassium (K) in the tungsten alloy is 30 wt ppm to 90 wt ppm.

7. The tungsten wire according to claim 1, wherein a diameter of the tungsten wire is 0.3 mm to 1.0 mm.

8. A tungsten wire processing method comprising performing wire drawing using the tungsten wire according to claim 1.

9. An electrolyzed wire using a tungsten wire subjected to wire drawing of the tungsten wire processing method according to claim 8.

* * * * *